US006751965B1

(12) United States Patent
Gottlieb

(10) Patent No.: US 6,751,965 B1
(45) Date of Patent: Jun. 22, 2004

(54) REFRIGERATION MACHINE HAVING SEQUENTIALLY CHARGED CONDENSING CONDUITS

(76) Inventor: Steven D. Gottlieb, 2448 Rolling Plains Dr., Herndon, VA (US) 20171

( * ) Notice: Subject to any disclaimer, the term of this patent is extended or adjusted under 35 U.S.C. 154(b) by 0 days.

(21) Appl. No.: 10/330,337

(22) Filed: Dec. 30, 2002

(51) Int. Cl.[7] ..... F25B 5/00
(52) U.S. Cl. ..... 62/117; 62/196.4
(58) Field of Search ..... 62/117, 196.4, 62/498

(56) References Cited

U.S. PATENT DOCUMENTS

| | | | | |
|---|---|---|---|---|
| 1,790,237 A | | 1/1931 | King | |
| 2,244,312 A | | 6/1941 | Newton | |
| 3,069,867 A | | 12/1962 | Ringquist | |
| 3,357,199 A | | 12/1967 | Harnish | |
| 3,368,364 A | | 2/1968 | Norton et al. | |
| 3,430,453 A | | 3/1969 | Norton | |
| 3,481,152 A | | 12/1969 | Seeley | |
| 3,777,485 A | * | 12/1973 | Emerson | 60/690 |
| 4,722,197 A | | 2/1988 | McEntire | |
| 4,871,014 A | | 10/1989 | Sulzberger | |
| 5,775,318 A | * | 7/1998 | Haydock et al. | 126/110 R |

* cited by examiner

*Primary Examiner*—Melvin Jones

(57) ABSTRACT

A vapor compression type heat transfer system wherein plural condensing conduits are individually and sequentially charged with compressed refrigerant from a compressor. The condensing conduits discharge expanded refrigerant into a common expansion chamber or evaporator. Charging of the condensing conduits is controlled so that a first condensing conduit becomes fully charged, and gradually discharges its refrigerant into the expansion chamber. Upon sensing that the first condensing conduit is fully charged, connection from the compressor to the first condensing conduit is closed by a valve, and connection of the compressor to a second condensing conduit is opened. With the compressor operating constantly, all condensing conduits are sequentially charged, all condensing conduits simultaneously discharging refrigerant to the expansion chamber. Load imposed upon the compressor is periodically reduced as each depleted condensing conduit, after having internal pressure reduced to a minimum value, is in turn sequentially and periodically connected to the compressor.

8 Claims, 5 Drawing Sheets

REFRIGERATION MACHINE HAVING SEQUENTIALLY CHARGED CONDENSING CONDUITS

BACKGROUND OF THE INVENTION

1. Field of the Invention

The present invention relates to heat transfer devices such as a refrigeration machine of the vapor compression and expansion cycle type. The field of application of the invention includes refrigeration, air conditioning, heat pumps, and similar heat transfer applications of vapor compression machines.

2. Description of the Prior Art

Evolution of compression cycle type refrigeration systems has lead to many improvements in operation. These improvements may render a system more suited to a specific application, or may cause the system to become more efficient. Specific applications of a particular refrigeration system may include general purpose cooling, reversal of operation or "heat pump" operation, specific tasks such as ice making, and others. Various constructions have evolved to meet the application, efficiency, cost, and other requirements of a specific refrigeration system.

The prior art has suggested plural condensing circuits in a refrigeration system for accomplishment of diverse purposes. These purposes may include variation of capacity, staging, zoning, defrosting, liquid and gaseous phase control, maintaining equilibrium within a system, and still others.

Capacity variation typically occurs when heat is rejected to ambient air, which may vary significantly in its temperature. Thus, despite a constant load, appropriate heat exchange capacity with respect to the heat accepting medium must be varied. Capacity variation generally is illustrated in U.S. Pat. No. 1,790,237, issued to Jesse G. King on Jan. 27, 1931. Condensers are generally arranged in parallel, and are selectively activated by appropriate valves. In King's scheme, a first condenser is constantly charged from the compressor, while a second condenser is selectively and variably charged through a valve. No valve is present to prevent charging of the first condenser once a maximal pressure is reached in that condenser. By contrast, each condenser line or conduit in the present invention has a valve for preventing further charging while another line or conduit is charging.

It is also possible that the actual cooling load may vary. In an example, a building having plural designated cooling zones may have plural condensers, with one condenser dedicated to each zone. Even when there is only one temperature control zone, the load within that zone may vary. For example, when a system having a singular cooling zone cools a building which is susceptible to significant variations in occupancy, the system may be called upon to reject more or less heat. In both examples, plural condensers may be arranged in parallel, and activated as required.

An example is seen in U.S. Pat. No. 3,430,453, issued to John P. Norton on Mar. 4, 1969. In this scheme, plural condenser conduits are progressively opened and closed in order to maintain constant the pressure of refrigerant delivered to the expansion valve of an evaporator. By contrast, in the present invention, plural condenser conduits operate at different pressures with respect to one another, even though discharging refrigerant to the same evaporator.

Some refrigeration systems reject heat progressively from compressed refrigerant. This may occur, for example, since a desired temperature difference may be beyond the reach of a single condenser, especially in cases wherein two different media are selectively employed to dissipate rejected heat in stages. Even where the same heat accepting medium is employed, plural condensers arranged in parallel may be utilized to balance pressure conditions, control refrigerant between liquid and gaseous phases, and otherwise maintain equilibrium within a closed refrigeration system.

In U.S. Pat. No. 3,368,364, issued to John P. Norton et al. on Feb. 13, 1968, a valve enables utilization of one or two condensers, for purposes of preventing pressure fluctuation and its detrimental consequences. The valving scheme is similar to that seen in King. Again, a particular condenser or condenser conduit is constantly being charged when the compressor operates, and unlike the present invention, cannot be isolated from compressor output.

A further example is seen in U.S. Pat. No. 3,481,152, issued to William M. Seeley on Dec. 2, 1969. Pressure responsive valves enable charging of plural condenser conduits. However, unlike the present invention, one particular condenser conduit is always charged when the compressor operates. Remaining condenser conduits are charged responsive to detection of differing condenser pressures. By contrast, in the present invention, all condenser conduits are subjected to equal treatment, although they rotate functions in a repeating cycle of sequential charging, and experience differing degrees of charging with refrigerant at any one moment in time.

Heat may be recovered for use after being concentrated within a condenser. In modern heat pumps, heat exchangers employed for condensing and evaporation swap functions depending upon whether the system is called upon to heat or to cool. An example of a heat recovery scheme is seen in U.S. Pat. No. 3,069,867, issued to Clarence L. Ringquist on Dec. 25, 1962. Compressed refrigerant is selectively condensed in one or both of two condensers disposed in parallel. This choice enables a relatively great amount of heat of condensation to be concentrated within one condenser, for recovery of that heat for heating. At other times, when recovery is not desired, utilization of both condensers enables relatively greater rejection of heat to the air or to another medium. In the Ringquist scheme, selection of valve position depends upon whether heating is demanded. There is no provision for causing an alternating cycle wherein both condensers are alternately charged, as found in the present invention.

U.S. Pat. No. 4,722,197, issued to Byron McEntire on Feb. 2, 1988, describes an energy reclamation scheme employing two parallel condensers. However, there is no alternating cycle nor apparatus for assuring the same in the McEntire device, unlike the apparatus of the present invention.

In U.S. Pat. No. 2,244,312, issued to Alwin B. Newton on Jun. 3, 1941, two parallel condensers are located one inside and one outside a building. This arrangement enables an air conditioning system to reject heat to the ambient under normal conditions, and to reject heat to a part of the building requiring heating under other circumstances. There is no provision for assuring automatic alternating use of system condensers, unlike the apparatus of the present invention.

In a further example of diverse purposes, as seen in U.S. Pat. No. 3,357,199, issued to James R. Harnish on Dec. 12, 1967, plural parallel condensers enable isolation of one condenser for drainage purposes while maintaining the refrigeration system operable. As with the Ringquist scheme, the Harnish scheme varies total condenser capacity by selectively idling one or more condensers. Unlike the present invention, there is no recycling control wherein all condenser circuits are always utilized when the compressor is operating.

In other examples of refrigeration systems having plural condensers, refrigerant may be diverted from a condenser which normally rejects waste heat to a heat exchanger employed for partial melting of ice within an ice making machine or for defrosting an evaporator coil. Unlike the present invention, there is no automatic recycling control feature which selects a particular condenser or condenser conduit based upon characteristics within that condenser or condenser conduit. Rather, defrosting schemes respond to demand for defrosting.

Progress in efficiency of energy consumption has influenced compressor design, pressure and temperature parameters, and other design aspects. However, none of the purposes discussed above nor efficiency considerations shows automatic sequential or rotating control of the valve arrangement characterizing the instant refrigeration system.

SUMMARY OF THE INVENTION

The present invention improves upon efficiency of vapor compression and expansion cycle type heat transfer devices such as refrigeration systems and machines. Many principles of operation and components are generally conventional, apart from certain novel improvements described herein.

Major components of the novel refrigeration system include a compressor, a condenser or heat rejecting heat exchanger served by plural condensing conduits conducting compressed refrigerant from the compressor, and an expansion chamber or heat exchanger for absorbing heat. The invention adds, in addition to the plural condensing conduits, a valve located between the output of the compressor and the plural condensing conduits, and a valve controller. The valve is arranged to distribute compressor output of compressed refrigerant among the condensing conduits such that each condensing conduit is charged individually, and all condensing conduits are charged in sequential fashion. While any one condensing conduit is being charged, remaining condensing conduits are isolated from compressor output. All condensing conduits communicate simultaneously through respective conventional evaporation orifices or equivalent conduits into the expansion or evaporation chamber of the heat absorbing heat exchanger.

A novel arrangement of valves directs compressed refrigerant from the compressor sequentially to each one, and only to that one, of the plural condensing conduits until the selected condensing conduit reaches a maximum charge and resultant pressure. Only one of the condensing conduits is being charged at any one time.

After a first condensing conduit is fully charged, the next condensing conduit to be charged is opened to the compressor output and the condensing conduit which has just been fully charged is closed to the compressor output by appropriate valves. If there are more than two condensing conduits, the remaining condensing conduits are also closed to the compressor output. After the second condensing conduit is fully charged, it is disconnected from output of the compressor, and a subsequent conduit is connected.

This pattern is repeated until the last available condensing conduit is charged. After the last condensing conduit is fully charged, the first condensing conduit is once again charged. This marks the beginning of a new cycle. At any one point in time after the first cycle is complete, each one of the various condensing conduits is charged with refrigerant to an extent different from that of the other condensing conduits. This is because condensed refrigerant immediately starts to escape from its condensing conduit into the expansion chamber immediately upon charging. Refrigerant pressure within each condensing conduit starts to decline from its peak value as soon as communication with the output of the compressor is closed by a valve.

When a new cycle begins, the first condensing conduit is once again connected to the compressor output. Immediately prior to reconnection, pressure within the first condensing conduit has diminished by expansion into the expansion chamber until the first condensing conduit is now the condensing conduit with the lowest internal pressure.

The advantage of this arrangement is that at the beginning of the charging period for each condensing conduit, refrigerant pressure is at the lowest value it will attain throughout operation. Hence, loading of the compressor is minimized at this point in time, and although increasing, will be not be maximized until the condensing conduit is once again fully charged. The average load imposed on the compressor is thus reduced from the peak load.

By contrast, in a conventional system, as soon as equilibrium of pressure within the condensing circuit is attained, the compressor is continuously subjected to maximal loading. That is, in a conventional system, the compressor is constantly or continuously forcing additional refrigerant into a condensing line which has attained and maintains its maximal internal pressure, hence subjecting the compressor to maximal backpressure, within minor variations.

It is well established practice to delay commencing operation of a refrigeration compressor immediately or shortly after operation has been halted. This delay period allows condenser pressure to diminish by spontaneous evaporation or expansion into the expansion chamber of compressed refrigerant contained within the condenser. Loading of the compressor when starting after a suitable delay is not objectionably burdensome since pressure prevailing within the condenser has abated.

However, the prior art has not appreciated the benefits of continuously operating the compressor when the condenser experiences less than peak pressure. The present invention periodically reproduces this condition by sequential charging the plurality of condensing conduits. In the present invention, the compressor is continuously operating, thereby avoiding reduction in power or rate of heat transfer when the compressor is idle, as it would be in prior art systems which have temporarily ceased compressor operation.

In summary, the present invention has apparatus for assuring rotating or sequential charging of plural condensing conduits while the compressor operates continuously in a refrigeration system. Interruption of sequential charging or of compressor operation is incidental, such as will periodically occur when demand for chilling is satisfied, and the entire system is shut down. But with the compressor of the refrigeration system continuously operating when demand is not yet satisfied, the load imposed upon the compressor will periodically be reduced as each newly depressurized condensing conduit is connected to the output of the compressor.

Accordingly, it is an object of the invention to reduce average loading imposed upon the compressor of a vapor compression type refrigeration system while maintaining continuous compressor operation.

It is another object of the invention to control sequential charging of condensing conduits responsive to each condensing conduit becoming fully charged in turn.

Still another object of the invention is to achieve periodic load reduction imposed on the compressor without discontinuing compressor operation.

An additional object of the invention is to utilize generally conventional components of a vapor compression type refrigeration system.

It is an object of the invention to provide improved elements and arrangements thereof in an apparatus for the purposes described which is fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
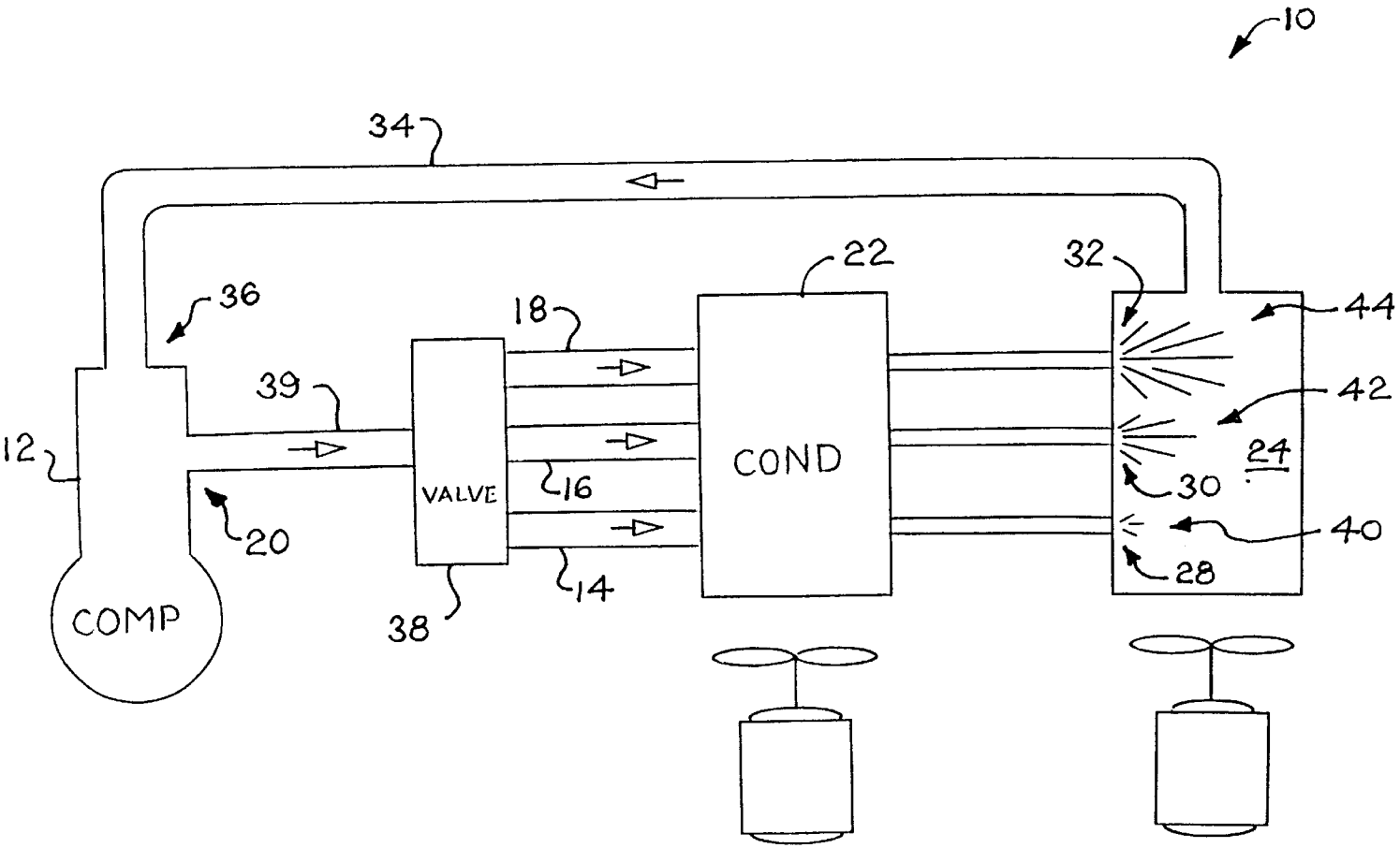
FIG. 1 is a diagrammatic representation of refrigerant handling components of a refrigeration system improved by the present invention.

The general principle of operation of the novel heat transfer system is explained with reference to FIG. 1, wherein the invention is representatively set forth as a refrigeration system 10. It will be understood that heat can be transported from one medium or location to another, either being imported to a specified location, such as by systems popularly known as heat pumps, or alternatively being rejected, such as by systems popularly known as air conditioning and refrigeration systems, and that the present invention encompasses all purposes of heat transport. For the purpose of semantic clarity, description will be directed to refrigeration systems. A working fluid necessary to heat transfer will be called refrigerant for semantic clarity and brevity, regardless of the purpose satisfied.

Refrigeration system 10 is of the vapor compression and expansion cycle type wherein a compressor 12 provides an output of compressed refrigerant to a plurality of condensing conduits 14, 16, 18 disposed in fluid communication with the output port or discharge side 20 from which compressed refrigerant is discharged from compressor 10. Unlike conventional refrigeration machines (not shown), refrigeration machine 10 sequentially charges each one of condensing conduits 14, 16, 18. Heat is rejected from the refrigerant in each condensing conduit 14, 16, or 18 in a condenser 22.

Condenser 22 dissipates heat from condensing conduits 14, 16, 18 into a common stream of air or other fluid heat accepting medium. This is accomplished by routing all condensing conduits 14, 16, 18 through condenser 22 in heat exchange relation to the heat accepting medium passing through condenser 22. Condensing conduits 14, 16, 18 do not communicate among one another in condenser 22.

Condensing conduits 14, 16, 18 extend from condenser 22 to an expansion chamber 24 within a heat exchanger 26. Actual heat exchange occurs substantially in condenser 22. Each condensing conduit 14, 16, or 18 has its own expansion valve or orifice 28, 30, or 32 (respectively). All expansion orifices 28, 30, 32 open into common expansion chamber 24. Expanded refrigerant is conducted through a return conduit 34 to the suction side 36 of compressor 12, which suction side 36 draws expanded refrigerant into compressor 12 for starting a new compression cycle of the refrigerant. Thus refrigeration machine 10 includes a closed loop refrigerant circuit for recirculating refrigerant during continuous operation.

Each condensing conduit 14, 16, or 18 is connected in interruptible fluid communication with compressed refrigerant supplied by compressor 12. This is accomplished by a distributing valve assembly 38 which distributes compressed refrigerant as follows. Valve assembly 38 selectively opens fluid communication between a conduit 39 conducting compressed refrigerant from discharge side 20 of compressor 12 and any selected one of condensing conduits 14, 16, 18. Valve assembly 38 simultaneously closes fluid communication between discharge side 20 and all remaining condensing conduits 14, 16, 18. Therefore, output from compressor 12 charges one condensing conduit 14, 16, or 18 at a time.

Starting for semantic purposes with conduit 14 being charged first, valve assembly 38 opens conduit 14 to discharge side 20 until conduit 14 is suitably charged. During charging of conduit 14, valve assembly 38 closes conduits 16 and 18 to discharge side 20. After sufficient charging of conduit 14, valve assembly 38 isolates condensing conduit 14, or closes communication from discharge side 20 of compressor 12 to condensing conduit 14, which has just attained full charge, and opens communication from discharge side 20 to subsequent condensing conduit 16. When the subsequent condensing conduit 16 attains full charge, valve assembly 38 again closes communication to discharge side 20 to the fully charged condensing conduit 16, and opens communication from discharge side 20 to the next condensing conduit 18.

When condensing conduit 18 is fully charged, a cycle is completed. Valve assembly 38 then commences a new cycle by enabling charging of conduit 14. This sequential or rotating pattern of charging condensing conduits 14, 16, 18 causes each condensing conduit 14, 16, or 18 to have an internal pressure and discharge rate of refrigerant into chamber 24 to vary from those of the other condensing conduits 14, 16, or 18. This is indicated by magnitude of representative spray patterns 40, 42, 44 (respectively) of condensing conduits 14, 16, 18.

It will be recalled that although communication with compressor 12 is discontinued periodically, expansion orifices 28, 30, 32 are always open. Therefore, compressed refrigerant constantly discharges or alternatively stated, continuously discharges from each condensing conduit 14, 16, or 18 at a progressively decreasing rate. After the last condensing conduit 18 is charged, an equilibrium is established in which the total volume of refrigerant escaping into expansion chamber 24 is relatively constant as long as compressor 12 operates.

Figure 2:
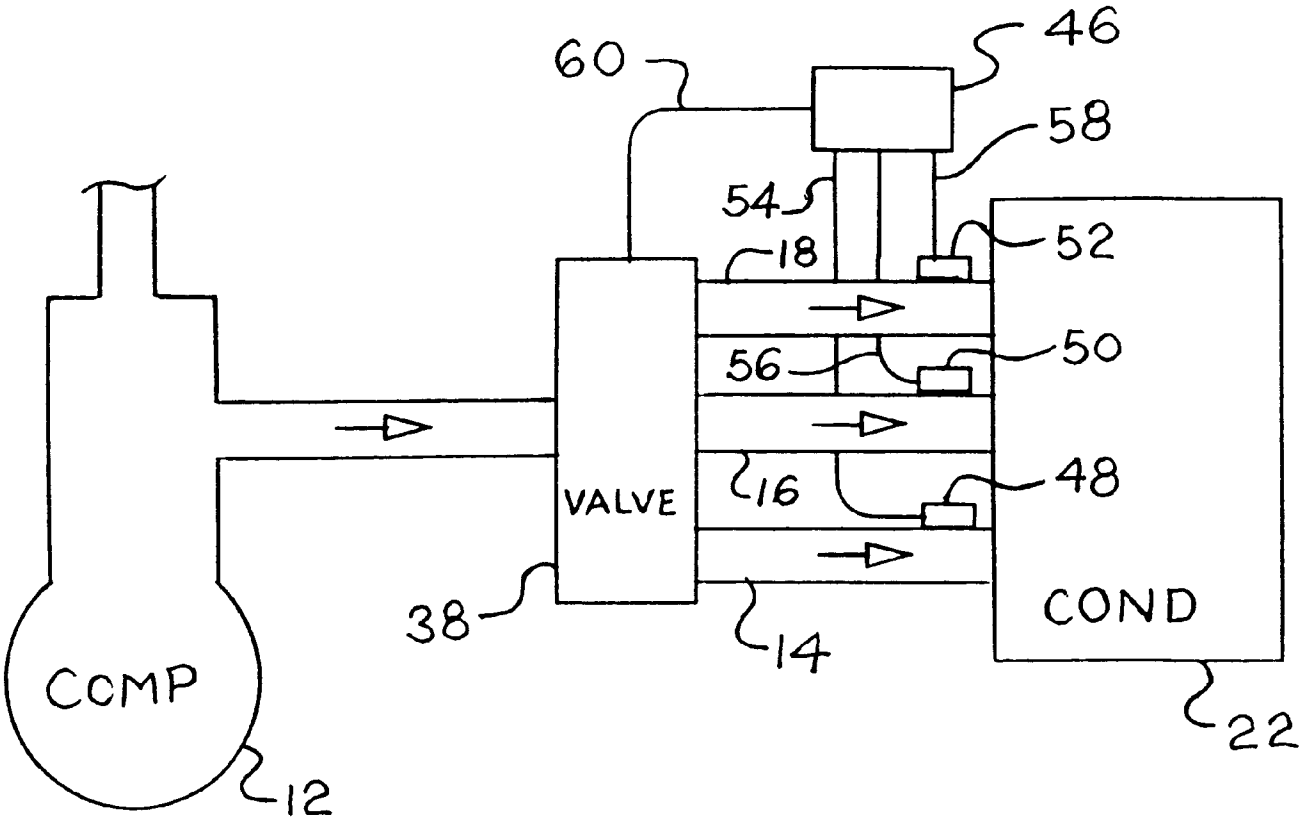
FIG. 2 is a diagrammatic detail view of control components of the improved refrigeration system.

As shown in FIG. 2, a suitable control scheme is provided for automatically causing valve assembly 38 to accomplish the foregoing sequential pattern of operation in repeating cycles while compressor 12 operates continuously. Control is provided by a suitable valve control apparatus 46 which generates signals for operating valve assembly 38 responsive to input signals generated by sensors 48, 50, 52. Control apparatus 46 then generates an appropriate signal for operating valve assembly 38.

Prior to further description of the control scheme, the nature of valve assembly 38 must be clarified. Valve assembly 38 is representative of any single valve which distributes incoming compressed refrigerant from compressor 12 among three flow paths. Each flow path is connected exclusively to and represented by one condensing conduit 14, 16, or 18. Obviously, valve assembly 38 may, for example, comprise a single component incorporating a manifold providing the aforementioned distribution. Alternatively, a plurality of individual valves (not shown) connected appropriately by conduits (not shown) may be provided. Operating signals for controlling the precise type of valve arrangement adopted will differ according to the embodiment of the valve arrangement.

Each sensor 48, 50, or 52 monitors a single, associated condensing conduit 14, 16, or 18 (respectively), and determines when its associated condensing conduit 14, 16, or 18 is charged. Each condensing conduit 14, 16, or 18 generates a signal responsive to detection of the charged condition. These signals are transmitted to control apparatus 46 by suitable communications cables, such as by electrical conductors 54, 56, 58. Of course, many types of communications methods, such as optical, pneumatic, and others, may be employed.

Similarly, many types of sensors are possible, and many different characteristics of operation may be utilized to generate appropriate signals for operating valve assembly 38. Determination of an appropriate point in the cycle to change position of the individual valves (not shown) of valve assembly 38 may be based upon any of several options. Valve operation may be determined by measurement of passage of real time. In this example, individual valves may be solenoid operated, and the solenoids (not shown) may be energized through recycling timing relays (not shown).

Another method of relying upon passage of time would be to link valve operation to the number of strokes of a compressor piston (not separately shown) or number of rotations of a compressor shaft (not separately shown). A controlling cam or equivalent member (not shown) may be geared to the shaft of compressor 12, and count partial, whole, or multiple revolutions. This cam or equivalent member may be connected to or even form a part of an individual valve.

Sensors 48, 50, 52 may alternatively comprise pressure translators or pressure transducers. Each pressure translator, which may be a diaphragm device for example, monitors pressure within its respective condensing conduit 14, 16, or 18, and closes or opens one or more individual valves. Where electrical control signals are employed, a pressure transducer opens or closes electrical contacts (not separately shown) to generate a signal for operating one or more valves.

Another method for controlling valves is to monitor level of liquid refrigerant accumulating within each condensing conduit 14, 16, or 18. Each condensing conduit 14, 16, or 18 may be monitored optically, or for degree of vibration, weight, or capacitance or other parameter which would be characteristic of a fully charged condition existing within a condensing conduit 14, 16, or 18.

Other parameters may be monitored to determine either directly or by inference that a particular condensing conduit 14, 16, or 18 is fully charged. An example is mass of flow or velocity of flow within each individual condensing conduit 14, 16, or 18.

Figure 3:
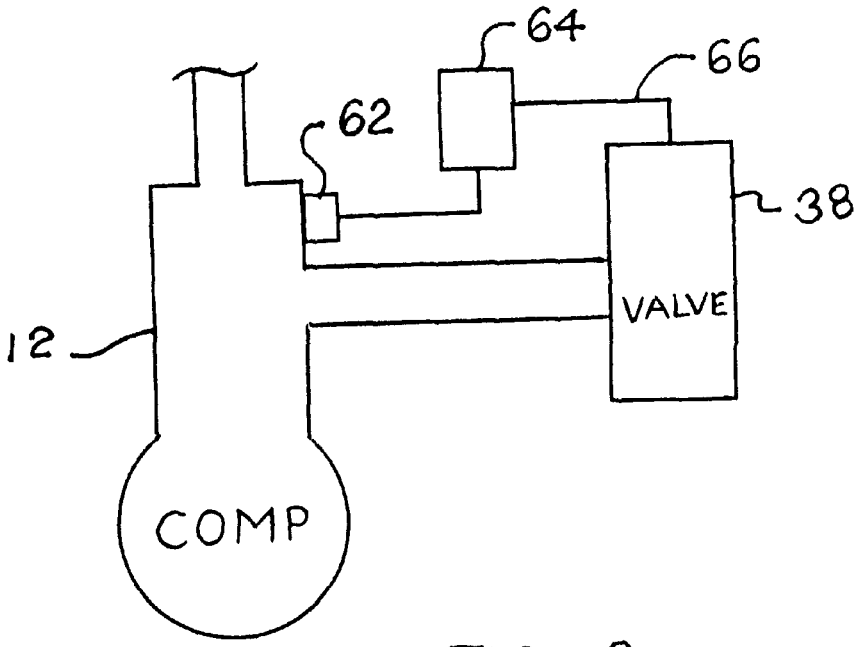
FIG. 3 is a diagrammatic detail view of control components of an alternative embodiment of the improved refrigeration system.

Another example is a characteristic sonic signature developed within each condensing conduit 14, 16, or 18 or within compressor 12 as a consequence of vibration and fluid flow. FIG. 3 illustrates an alternative control arrangement wherein a sensor 62 is mounted to compressor 12. Signals generated by sensor 62 are transmitted to a control apparatus 64 through a communications cable 64. Signals generated by control apparatus 64 are transmitted to valve assembly 38 through a communications cable 66.

Of course, sensors 48, 50, 52 may monitor their associated condensing conduits 14, 16, 18 from a distance, if the monitored parameter is detectable from a remote location. As an example, sonic signature and vibration could be monitored through the air, or through a rigid or sonically transmissive component of the system, such as metallic tubing, a wall of structural components of the refrigeration machine, the compressor head or evaporator, and the like.

Electrical characteristics of the compressor motor (not separately shown), such as power factor or motor current, may be monitored to generate a command to move to the next step in the cycle. Also, changes in or levels of temperature at compressor 12, within each condensing conduit 14, 16, or 18, or at the evaporation orifice 28, 30, or 32 of each individual condensing conduit 14, 16, or 18 may be monitored. A selected characteristic may be communicated to control apparatus 46, which then generates an appropriate command signals transmitted to valve assembly 38 through an electrical conductor 60.

Control apparatus 46 or 62 will be understood to have all necessary components for carrying out the above described control scheme. Control apparatus may comprise control and alternating relays (not shown), a microprocessor (not shown), or any other type of device capable of determining first and subsequent charging intervals responsive to signals from sensors 48, 50, 52, or from sensor 62, in the case of control apparatus 62, for charging condensing conduits 14, 16, 18, and for generating operating signals in the repeating, sequential pattern outlined above.

Refrigeration machine 10 may take either self-contained form or modular form. Self-contained signifies that all components of the machine are mounted to a common chassis or equivalent supporting structure, are enclosed within a common housing, or both. Examples of self-contained machines include residential refrigerators and air conditioning units intended for through-the-wall or window mounting.

Modular form signifies that components of the overall system are separate from one another after assembly and after being rendered operable by charging with refrigerant and being connected to power. An example of a modular form is a residential air conditioner known as a split system. In a typical split system, the compressor and condenser are combined in self-contained form and are mounted on a concrete pad on the ground adjacent the building being served or on a roof thereof. The evaporator of a typical split system is mounted inside the building, and may or may not include a fan for a forced air distribution system.

Individual components of the present invention may be provided for commercial distribution and assembly into complete refrigeration systems such as a split system. Each individual component includes integral short, open or unconnected refrigerant conduits (concealed within valve assembly 38 and condenser 22) which by themselves form partial refrigerant circuits. These unconnected conduits or partial refrigerant circuits will be incorporated into complete refrigerant circuits during assembly of an operational system. These components would be suitable for assembling a refrigeration machine or system according to the present invention, but structure modifying these components to the inventive concept lacks purpose in other applications.

In an example of individual components provided for incorporation into operation systems, compressor 12 with or without condenser 22 may be furnished with a valve assembly 38 formed integrally therewith or removably connected thereto. In such an occurrence, compressor 12 may be furnished with or without control apparatus 46 or 62. In another example, condenser 122 may be provided apart from compressor 112, wherein condenser 122 includes partial sections 114A, 116A, 118A of condensing conduits complementing conduits 114, 116, and 118. In a further example, heat exchanger 26 and evaporator 104 may be provided in self-contained form.

Figure 4:
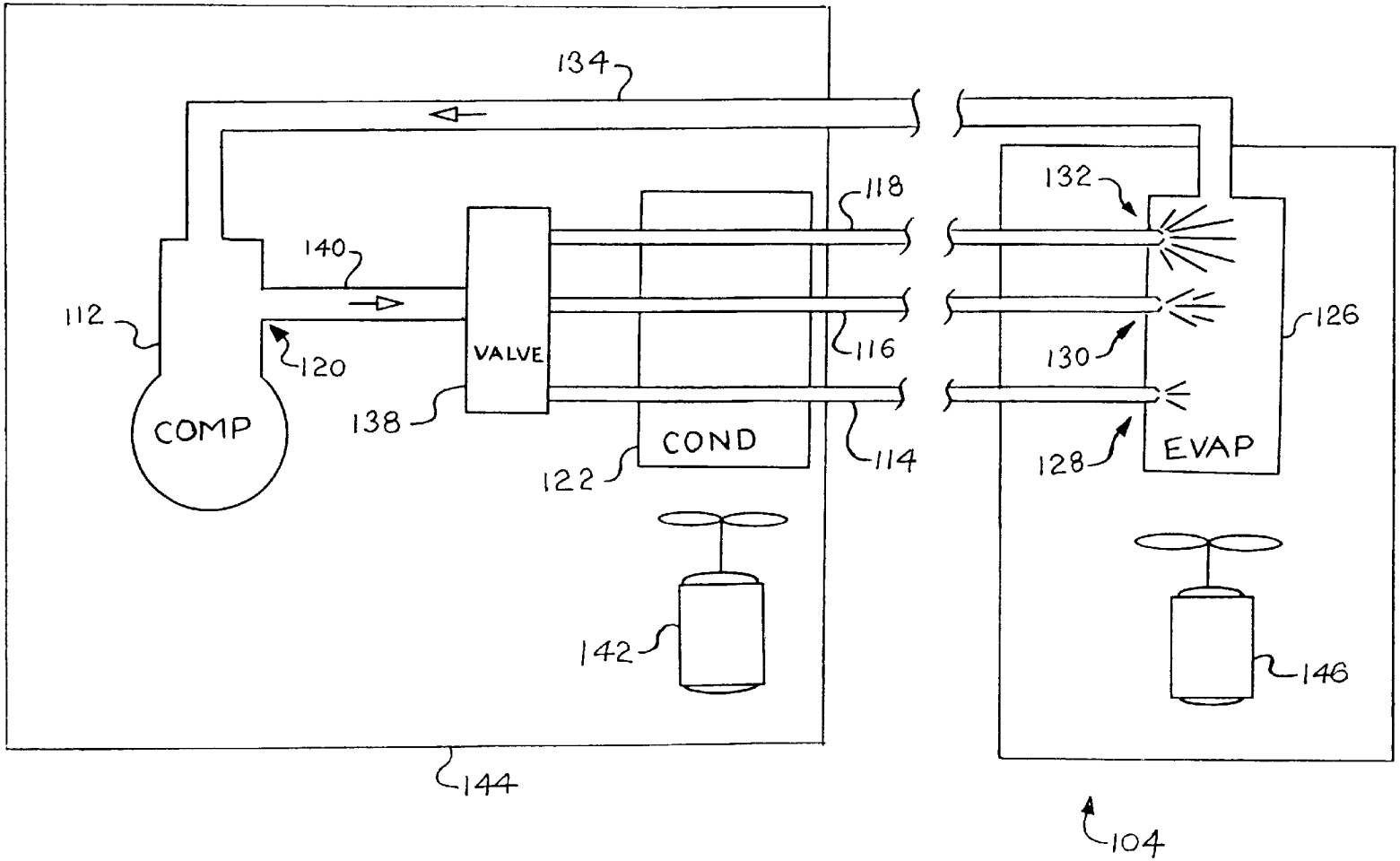
FIG. 4 is a diagrammatic representation of an alternative embodiment of an improved refrigeration in a form frequently used in residential construction and known as a "split system".

Application of the present invention to a split system 100 is shown in FIG. 4. Outdoor unit 102 includes compressor 112, condensing conduits 114, 116, 118, condenser 122, evaporator 126, and return conduit 134. A valve assembly 138 distributes compressed refrigerant from discharge side 120 of compressor 112 to condensing conduits 114, 116, 118 sequentially as described regarding the embodiment of FIG. 1. Control components comparable to those of the embodiment of FIG. 2 or 3 will be understood to be provided, but are omitted for clarity in FIG. 4. A conduit 140 conducts compressed refrigerant from discharge side 120 of compressor 112 to valve assembly 138.

Outdoor unit 102 includes a fan 142 for forcing ambient air through condenser 122. A housing 144 encloses all components outdoor unit 102. Fan 142 may be disposed and controlled in conventional fashion to force air being cooled through condenser 122 for heat exchange purposes. Housing 144 is also generally conventional, and is louvered to pass forced air to dissipating heat.

Indoor unit 104 is an air handling unit, comprising evaporator 126 and an evaporator fan 146. Fan 146 may be disposed and controlled in conventional fashion to propel air across evaporator 126. Evaporator 126 has evaporation orifices 128, 130, 132 associated with condensing conduits 114, 116, 118, respectively.

Figure 5:
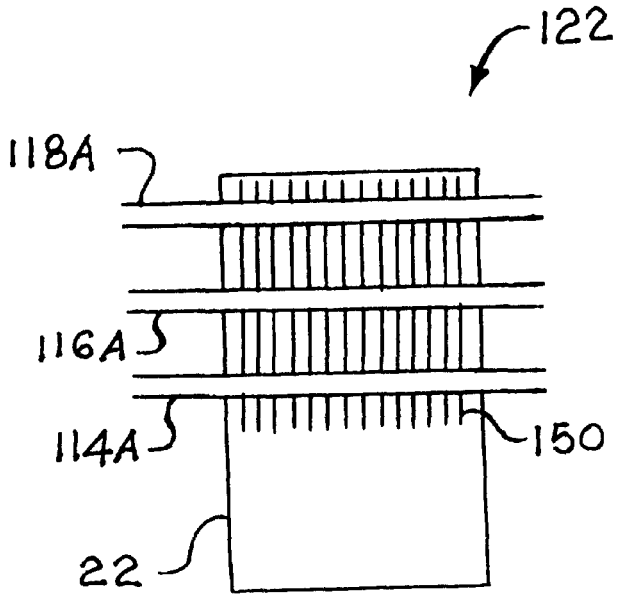
FIG. 5 is a diagrammatic detail view of a refrigeration condenser modified according to the present invention.

Condenser 122 is shown in greater detail in FIG. 5. Condenser 122 is unitary, signifying that condenser 122 is a single, integral component wherein all conduits are structurally supported in common to a chassis. A chassis will be understood to comprise an external housing (not separately shown), internal structural members engaging individual condensing conduits and holding the condensing conduits in fixed position, or both external housing and internal structural members. Condenser 122 is provided with conduits 114A, 116A, and 118A which after assembly will form part of the refrigerant circuits provided by conduits 114, 116, and 118. Conduits 114A, 116A, and 118A may be mutually joined by solid internal structural members which may include cooling fins 150, thereby rendering all components of condenser 122 mechanically connected and supported in fixed position.

Apparatus for carrying out the invention has thus been set forth. The invention may also be regarded as a method for operating a vapor compression refrigeration system. The novel method comprises the minimum steps of:

a) selectively charging one condensing conduit 14, 16, or 18 while isolating other condensing conduits 14, 16, 18 from output of compressed refrigerant from compressor 12;

b) subsequently charging another condensing conduit 14, 16, or 18 while isolating remaining condensing conduits 14, 16, 18 from output of compressed refrigerant from compressor 12;

c) operating compressor 12 continuously during steps a) and b); and d) discharging compressed refrigerant continuously from condensing conduits 14, 16, 18 into a common expansion chamber 24 while operating compressor 12.

Figure 6:
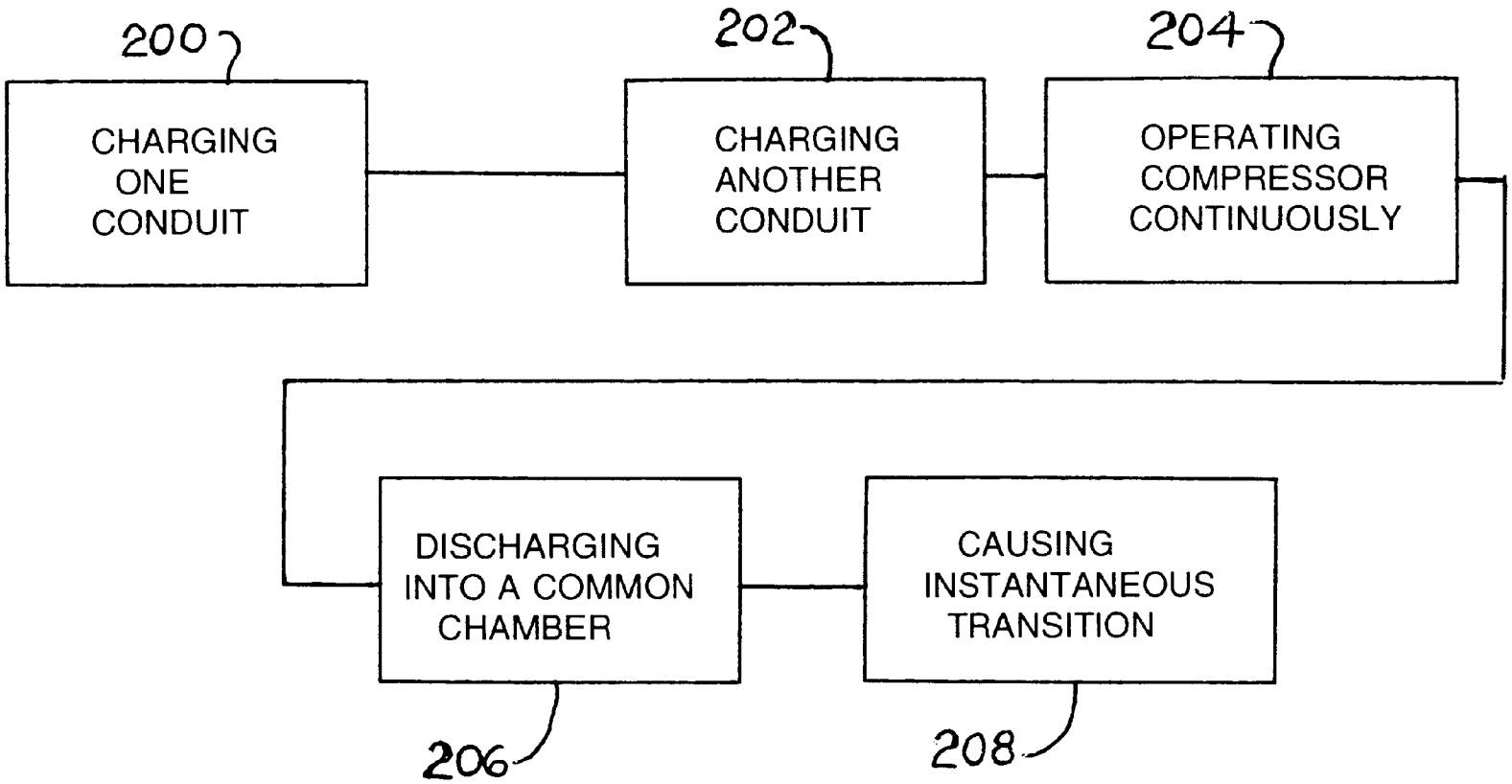
FIG. 6 is a block diagram showing steps of a method of operating a refrigeration system according to the present invention, and is read from left to right.

Of course, the method is most effective when a further step e) causing instantaneous transition from step a) to step b), when changing which condensing conduit 14, 16, or 18 is being charged, while operating compressor 12 continuously during transition, is practiced. Steps a, b, c, d, and e are summarized in FIG. 6 as steps 200, 202, 204, 206, and 208, respectively. The method may be practiced with apparatus limited to performing the method, as shown herein, or alternatively with apparatus (not shown) modified to perform additional functions.

The invention may be practiced with both single stage compression, as illustrated prior, and also with plural stages of compression. Plural stages of compression may be practiced with a single compressor having plural compression stations or chambers, with plural individual compressors, or with any combination of the two. When plural stages of compression are employed, it is preferred to reject heat from refrigerant exiting one stage of compression prior to being compressed in a subsequent stage of compression.

It should be noted that any type of refrigeration system devoted to any purpose may be improved by the inventive concept. For example, the system may be an air conditioner for residences and other buildings or for motorized vehicles, a residential or commercial enclosed refrigerator for preserving perishables, or for any other industrial, residential, or commercial application.

Any type of refrigerant compressor, condensing or heat rejecting heat exchanger, and expansion or heat absorbing chamber heat exchanger may be employed. Examples of compressors include, but are not limited to, reciprocating piston types, scroll compressors, centrifugal compressors, and sonic compression wave generators. The latter is a type which causes a compression wave to propagate through a chamber charged with refrigerant, with a limited zone of maximally compressed refrigerant passing through a valve while relatively uncompressed refrigerant remains in the wave chamber. The type of refrigerant may be selected from many substances, as long as it satisfies the compression and expansion cycle principle.

It will be appreciated that the refrigeration system need not necessarily be of the type to change its refrigerant between liquid and gaseous states. For example, in some applications, it may be desirable to employ helium as a refrigerant. In this example, helium refrigerant varies in its pressure and temperature, but may constantly remain in the gaseous phase. Reference throughout the description of the invention to condensing of a refrigerant is merely representative of expansion, is employed for clarity of understanding only, and is not actually a necessary condition of the invention.

The present invention is susceptible to variations and modifications which may be introduced thereto without departing from the inventive concept. For example, the invention may be applied to devices for producing heat rather than rejecting heat, such as heat pumps, with appropriate modifications introduced, and not just to devices solely dedicated to cooling. Of course, the invention may also be applied to devices adapted to operate reversibly so as to move heat selectively in opposed directions. In a second example, supply and return conduits 140 and 134, or their counterparts in other embodiments, may be deleted by arranging appropriate components in proximity to one another or by interposing other components (not shown).

Also, the sequential pattern of charging of condenser conduits need not mandate identical cycles. By way of example, if a so many condensing conduits are provided such that more than one condensing conduit which has attained the lowest possible internal refrigerant pressure is available for recharging, the sequential pattern of charging could be varied to select any such available condensing conduit. Even if there were no plurality of depleted condensing conduits, a condensing conduit which is not fully depleted could be selected for recharging, although such a course could possibly dilute effectiveness of the invention.

In another example of variation or modification, although fan 142 is shown in FIG. 4 for rejecting heat to ambient air, the invention is not necessarily limited to heat rejection by this method. Any method of rejecting heat from conduits 14, 16, 18 or 114, 116, 118 may be employed, such as by immersion within a liquid cooling medium (not shown) which may be either actively or passively circulated.

It would be considered the equivalent of providing valves to accomplish the novel sequential charging arrangement by providing separate compressors selectively coupled to a sole prime mover, if each compressor had a dedicated condensing conduit, and if at least two dedicated condensing conduits communicated with a single evaporator or expansion chamber.

In cases wherein at least two condensing conduits are subjected to the automatic recycling system of sequential charging, one or more additional condenser lines may be provided which are not so controlled, for example being constantly charged by a portion of the total refrigerant discharged by the compressor, although a modification such as this could dilute effectiveness of the invention.

Significant components of the heat transfer system such as, for example, the compressor may incorporate other components as an integral part, or alternatively, may be connected by conduits. Illustratively, the distributing control valve represented by valve assembly 38 may be connected by conduits to the compressor and to the condenser, or alternatively may be formed as part of the compressor or alternatively as part of the condenser.

Significant components of the heat transfer system may additionally serve unrelated functions or may be part of systems serving additional functions. For example, in motor vehicle applications, the distributing control valve may be controlled by a computer which is conventionally furnished as part of a motor vehicle to provide engine and transmission management functions. It will be appreciated that in the example of motor vehicle applications providing a computer, optimum control of the power plant is possible. That is, a computer can manage the engine of the vehicle to produce power exactly according to the sum total power demands for both automotive purposes such as propulsion and also for other purposes such as operating the air conditioning compressor. As the load imposed on the engine increases as any one condensing conduit approaches peak charging, the engine increases power output available to the compressor accordingly under the most efficient conditions without requiring that the operator of the vehicle make any adjustments to engine operations. Of course, demands on power unrelated to compressor operation, such as steering, acceleration, accommodating added electrical loads such as sound systems, windshield wiper operation, and others, may cause the sum total power demand to increase even when compressor power demands decrease.

Where components of the refrigeration system are referred to in the singular, plural such components may be provided. For example, plural evaporators or heat absorbing heat exchangers, each served by at least two condensing conduits, operated in parallel would be the equivalent of the single evaporator shown herein. It is not necessary that all condensing conduits serve only one evaporator. Also, plural compressors arranged in parallel would be the equivalent of a single compressor.

In a further example, plural condensing conduits may be charged simultaneously while, for example, other condensing conduits remain idle. If plural condensing conduits are operated simultaneously, the same principles apply as set forth concerning single conduits.

It will be appreciated that the order of charging of condenser conduits may be varied from a strict repeating or sequential order as described prior, although varying the order of charging could possibly dilute effectiveness of the invention.

The number of condensing conduits may be two or any number greater than two.

It is to be understood that the present invention is not limited to the embodiments described above, but encompasses any and all embodiments within the scope of the following claims.

I claim:

1. A heat transfer system of the vapor compression and expansion cycle type, comprising:

a compressor disposed to compress a refrigerant, said compressor having a suction side disposed to draw refrigerant into said compressor and a discharge side disposed to discharge compressed refrigerant from said compressor;

a plurality of condensing conduits connected in interruptible fluid communication with said discharge side of said compressor, arranged in parallel to one another with regard to the refrigerant circuit, and disposed to reject heat from compressed refrigerant;

valve apparatus disposed to selectively open fluid communication between said discharge side of said compressor and any selected single one of said plurality of condensing conduits, while simultaneously closing fluid communication between said discharge side of said compressor and all remaining ones of said plurality of condensing conduits; and an expansion chamber disposed to receive compressed refrigerant from said plurality of condensing conduits and to expand compressed refrigerant, said expansion chamber having passages enabling continuous fluid communication between each one of said plurality of condensing conduits and said expansion chamber.

2. The heat transfer system according to claim 1, further comprising control apparatus disposed to cause said valve apparatus to operate automatically in a repeating, sequential pattern wherein each one of said plurality of condensing conduits is charged by output of said compressor while other ones of said plurality of condensing conduits simultaneously are isolated from output of said compressor, said control apparatus causing said repeating, sequential pattern to proceed during continuous operation of said compressor.

3. The heat transfer system according to claim 1, further comprising a heat exchanger having an expansion chamber disposed to receive compressed refrigerant from said condensing conduits and to expand compressed refrigerant received from said condensing conduits, said expansion chamber having passages providing constant fluid communication between each one of said condensing conduits and said expansion chamber.

4. The heat transfer system according to claim 3, further comprising a closed loop refrigerant circuit for recirculating refrigerant during continuous operation.

5. A heat transfer system of the vapor compression and expansion cycle type, comprising:

a compressor disposed to compress a refrigerant, said compressor having a suction side disposed to draw refrigerant into said compressor and a discharge side disposed to discharge compressed refrigerant from said compressor;

a plurality of condensing conduits connected in interruptible fluid communication with said discharge side of said compressor, arranged in parallel to one another with regard to the refrigerant circuit, and disposed to reject heat from compressed refrigerant;

valve apparatus disposed to selectively open fluid communication between said discharge side of said compressor and any selected single one of said plurality of condensing conduits, while simultaneously closing fluid communication between said discharge side of said compressor and all remaining ones of said plurality of condensing conduits;

an expansion chamber disposed to receive compressed refrigerant from said plurality of condensing conduits and to expand compressed refrigerant, said expansion chamber having passages enabling continuous fluid communication between each one of said plurality of condensing conduits and said expansion chamber; and a heat exchanger having an expansion chamber disposed to receive compressed refrigerant from said condensing conduits and to expand compressed refrigerant received from said condensing conduits, said expansion chamber having passages providing constant fluid communication between each one of said condensing conduits and said expansion chamber.

6. The heat transfer system according to claim 5, further comprising control apparatus disposed to cause said valve apparatus to operate automatically in a repeating, sequential pattern wherein each one of said plurality of condensing conduits is charged by output of said compressor while other ones of said plurality of condensing conduits simultaneously are isolated from output of said compressor, said control apparatus causing said repeating, sequential pattern to proceed during continuous operation of said compressor.

7. A method of operating a vapor compression heat transfer system including a compressor providing an output of compressed refrigerant and a plurality of condensing conduits disposed in fluid communication with the compressor, comprising the steps of:

selectively charging one condensing conduit while isolating other condensing conduits from output of compressed refrigerant from the compressor;

subsequently charging another condensing conduit while isolating remaining condensing conduits from output of compressed refrigerant from the compressor;

operating the compressor continuously during said step of selectively charging one condensing conduit and said step of subsequently charging another condensing conduit; and discharging compressed refrigerant from all condensing conduits into a common expansion chamber continuously while operating the compressor.

8. The method according to claim 1, further comprising a further step of causing instantaneous transition from said step of selectively charging one condensing conduit to said step of subsequently charging another condensing conduit.

* * * * *